United States Patent [19]

Bennett

[11] Patent Number: 4,779,773

[45] Date of Patent: Oct. 25, 1988

[54] CONTAINER CAP WITH TURNABLE RETRACTABLE NOZZLE

[76] Inventor: Robert Bennett, 170 Sturbridge Rd., Easton, Conn. 06612

[21] Appl. No.: 141,050

[22] Filed: Jan. 5, 1988

[51] Int. Cl.[4] ..... B65D 3/00

[52] U.S. Cl. ..... 222/507; 215/313

[58] Field of Search ..... 222/536, 507; 215/307, 215/313

[56] References Cited

U.S. PATENT DOCUMENTS

| | | | |
|---|---|---|---|
| 3,094,255 | 6/1963 | Hunter | 222/507 |
| 3,371,827 | 3/1968 | Micallef | 222/536 X |
| 3,847,313 | 11/1974 | Micallef | 222/507 |

*Primary Examiner*—Donald F. Norton

[57] ABSTRACT

A vertical hollow cylinder is closed at its upper end, open at its lower end, and has a hole in the cylinder wall. First and second vertical parallel posts are secured to the upper end of the cylinder and extend downwardly inside the cylinder on opposite sides of the hole. The posts are adjacent the hole and are disposed adjacent but spaced apart from the inner surface of the cylinder wall. A vertical hollow cylindrical member is disposed rotatably within the first cylinder and has an open lower end, the cylinder and member having a common vertical axis. A flat circular disc is secured to and closes the upper end of the member, the center of the disc being aligned with the common axis, the disc having an off center opening and being provided with a vertical upwardly extending peripheral lip which extends partially around the disc. The disc is disposed within the first cylinder in such manner that the lip extends rotatably between the inner surface of the cylinder and both posts. A short vertical hollow tube open at both ends has its lower end flush with the opening in the disc and extends upwardly from the disc. An elongated hollow nozzle having a vertical discharge port at one end and a horizontal intake port at the other end is disposed above the disc with the tube extending through the horizontal port. The nozzle is rotatable about the tube between first and second extreme positions when the member is held stationary and the cylinder is rotated about the common axis. In the first position, the lip does not close the hole and the nozzle is fully extended outwardly through the hole. In the second position, the lip closes the hole and the nozzle is fully withdrawn into the cylinder and is spaced from the hole.

6 Claims, 1 Drawing Sheet

CONTAINER CAP WITH TURNABLE RETRACTABLE NOZZLE

BACKGROUND OF THE INVENTION

Containers filled with liquids, pastes and other materials are sometimes provided with dispensing caps which are provided with turnable retractable nozzles whereby the cap can be rotated to cause the nozzle to project through an opening in the cap for dispensing purposes and can also be rotated to withdraw the nozzle fully into the cap and close the opening when the container is to be taken out of use.

However, in caps of this type, some material will necessarily remain in the nozzle after a dispensing operation has been concluded. If this material is of such nature that it will dry up when exposed to air for an appreciable period, such material can dry up and plug the nozzle if the periods between successive dispensing operations are sufficiently long whereby the cap becomes unusable.

This invention is directed toward a new and improved cap of this type wherein this problem is overcome. In addition, this cap utilizes a minimum of component parts and can be manufactured inexpensively.

SUMMARY OF THE INVENTION

A container cap, in accordance with the principles of the invention, includes a vertical hollow cylinder which is closed at its upper end, open at its lower end, and has a hole in the cylinder wall.

First and second vertical parallel posts are secured to the upper end of the cylinder and extend downwardly inside the cylinder on opposite sides of the hole. The posts are adjacent the hole and are disposed adjacent but spaced apart from the inner surface of the cylinder wall.

A vertical hollow cylindrical member is disposed rotatably within the cylinder and has an open lower end, the cylinder and member having a common vertical axis. A flat circular disc is secured to and closes the upper end of the member, the center of the disc being aligned with the common axis, the disc having an off center opening and being provided with a vertical upwardly extending peripheral lip which extends partially around the disc. The disc is disposed within the first cylinder in such manner that the lip extends rotatably between the inner surface of the first cylinder and both posts.

A short vertical hollow tube open at both ends has its lower end flush with the opening in the disc and extends upwardly from the disc.

An elongated hollow nozzle having a vertical discharge port at one end and a horizontal intake port at the other end is disposed above the disc with the tube extending through the horizontal port. The nozzle is rotatable about the tube between first and second extreme positions as, for example, when the member is held stationary and the cylinder is rotated about the common axis. In the first position, the lip does not close the hole and the nozzle is fully extended outwardly through the hole. In the second position, the lip closes the hole and the nozzle is fully withdrawn into the cylinder and is spaced from the hole.

When this cap is used on a container filled with material which will dry when exposed to air for an appreciable period, in accordance with the invention, it is necessary to seal off the discharge port of the nozzle from further exposure to air immediately after completing a dispensing operation. When the port is so sealed, material remaining in the nozzle will not dry up and plug the nozzle, whereby additional dispensing operations can ensue successfully.

When this sealing action is needed, the end of the nozzle containing the discharge port can have the same contour as the inner surface of the cylinder wall so that this end can be moved into essentially air impermeable sealing engagement with this surface when the nozzle is moved into the second position.

DETAILED DESCRIPTION OF PREFERRED EMBODIMENT

Figure 1:
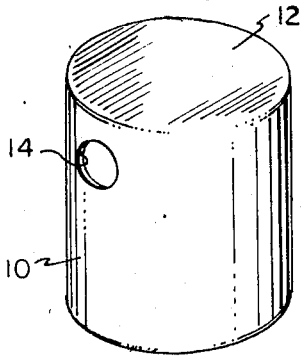
FIG. 1 is a perspective view of a cylinder used in the invention.
Figure 2:
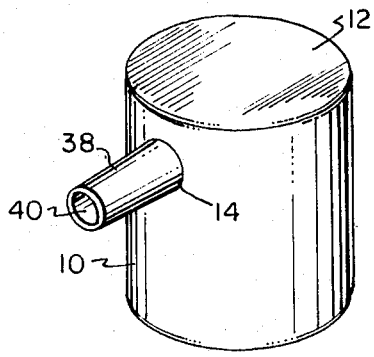
FIG. 2 is a perspective view of a cap in accordance with the invention with the nozzle extended.
Figure 3:
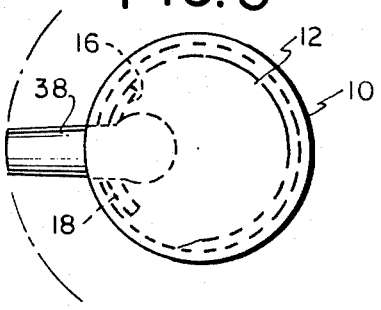
FIG. 3 is a top view of the structure shown in FIG. 2.
Figure 4:
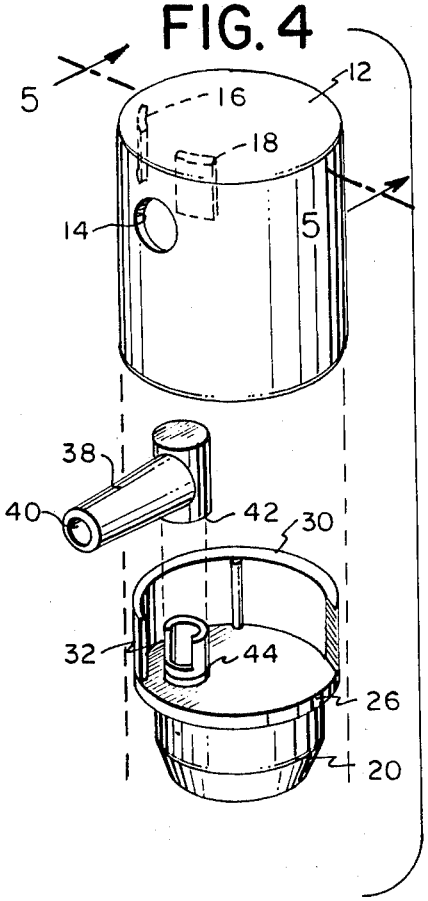
FIG. 4 is an exploded view of a cap in accordance with the invention.
Figure 5:
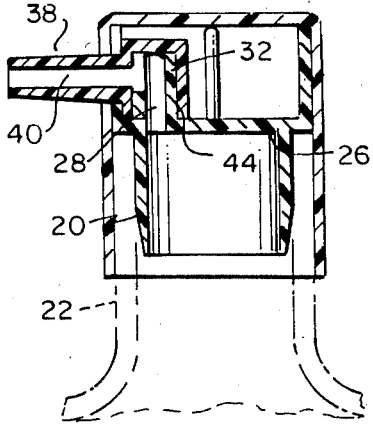
FIG. 5 is a cross section taken along line 5—5 in FIG. 4.
Figure 7A:
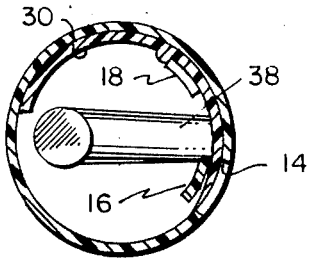
FIGS. 7A, 7B, 7C and 7D are horizontal cross sectional views of the cap of FIG. 4 which illustrate the successive steps in extending and withdrawing the nozzle.
Figure 7B:
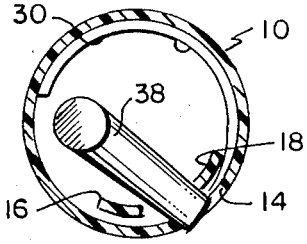
Figure 6:
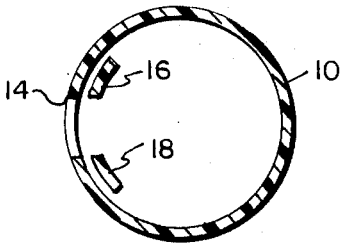
FIG. 6 is a horizontal cross section of the cylinder of FIG. 1.
Figure 7C:
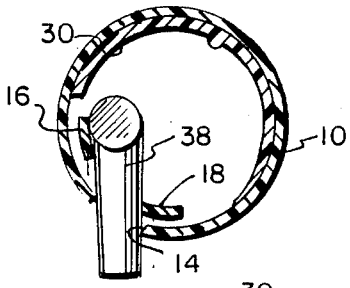
Figure 8:
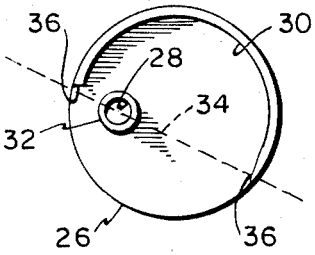
FIG. 8 is a plan view of the disc, lip and nozzle configuration used in the cap of FIG. 4.
Figure 7D:
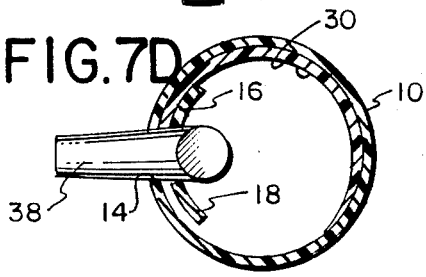

Referring now to FIGS. 1–8, a vertical hollow cylinder 10 has a closed upper end 12, an open lower end and a hole 14 in the cylinder wall adjacent the end 12. First and second vertical parallel posts 16 and 18 are secured to the upper end of the cylinder and extend downwardly inside the cylinder on opposite sides of the hole. The posts are adjacent the hole and are disposed adjacent but spaced apart from the inner surface of the cylinder wall.

A vertical hollow cylindrical member 20 is disposed rotatably within the cylinder. Member 20 has an open lower end and is smaller in diameter than cylinder 10 so that the neck 22 of a container 24 can be snap filled therebetween to secure the cap in position. A flat circular horizontal disc 26 having a diameter intermediate the diameters of the cylinder 10 and the member 20 is secured to and closes the upper end of member 20. Member 20 and cylinder 10 have a common vertical axis which extends through the center of the disc.

Disc 26 has an off center opening 28 which communicates with the interior of the container 24 and is provided with a vertical upwardly extending lip 30 which extends partially around the disc. The disc is disposed inside the cylinder 10 in such manner that the lip is disposed rotatably between the inner surface of the cylinder wall and the two posts.

A short vertical hollow tube 32 open at both ends has a lower end flush with opening 28 and secured to the disc. The tube extends vertically upward from the disc and its upper end is partially cut away. As viewed in the horizontal plane, the opposite ends 36 of the lip and the tube are disposed approximately along a common horizontal line 34.

An elongated hollow nozzle 38 has a vertical discharge port 40 at one end and a horizontal intake port 42 at the opposite end. The nozzle is disposed above the disc with the upper end of the tube extending into port 42. The nozzle is rotatable about the tube. A seal, such as O ring 44 is disposed between the port 42 and the lower end of the tube, to prevent air leakage into the nozzle. The end of the nozzle carrying the discharge port and the outer and inner surfaces of the cylinder have the same curvature.

When one of the cylinder and member is held stationary and the other is rotated, typically when the container is held stationary and the cylinder is rotated, the nozzle will be rotated about the tube between a first and second extreme position. The first position is the open position at which the lip does not close the hole 14 and the nozzle is fully extended outwardly through the hole. The second position is the closed position at which the lip closes the hole and the nozzle is fully withdrawn into the cylinder and is spaced from the hole.

A vertical stop pin 46 is disposed on the inside surface of the lip intermediate the ends of the lip to limit the degree of rotation of the nozzle in the closed position.

Because of the relative sizes of the components and the matching curvatures of the inner surface of the cylinder wall and the end of the nozzle containing the discharge port, this nozzle end is in air impermeable sealing relationship with this inner surface when the nozzle is in the second position.

What is claimed is:

1. A container cap comprising:

a vertical hollow cylinder closed at its upper end and open at its lower end, the cylinder having a hole in the cylinder wall disposed below the upper end;

first and second vertical parallel posts secured to the upper end of the cylinder extend downwardly inside the cylinder on opposite sides of the hole, the posts being adjacent the hole and disposed adjacent but spaced apart from the inner surface of the cylinder wall;

a vertical hollow cylindrical member disposed rotatably within the cylinder and having an open lower end, the cylinder and member having a common vertical axis;

a flat horizontal circular disc secured to and closing the upper end of the member, the center of the disc being aligned with the common axis, the disc having an off center opening and being provided with a vertical upwardly extending peripheral lip which extends partially around the disc, the disc being disposed within the first cylinder in such manner that the lip extends rotatably between the inner surface of the first cylinder and both posts;

a short vertical hollow tube open at both ends, the lower end of the tube being flush with the opening in the disc, the tube extending upwardly from the disc;

an elongated hollow nozzle having a vertical discharge port at one end and a horizontal intake port at the other end, the nozzle being disposed above the disc with the tube extending through the horizontal port, the nozzle being rotatable about the tube between first and second extreme positions when either one of the cylinder and member is held stationary and the other one is rotated about the common axis, the first position being the open position at which the lip does not close the hole and the nozzle is fully extended outwardly through the hole, the second position being the closed position at which the lip closes the hole and the nozzle is fully withdrawn into the cylinder and is spaced from the hole.

2. The cap of claim 1 wherein the curvature of the said one nozzle end conforms to the curvature of the inner surface of the cylinder wall and wherein said one nozzle end engages the inner surface to seal off the discharge port when the nozzle is in the closed position.

3. The cap of claim 2 wherein the tube and the opposite ends of the lip, as viewed in a horizontal plane, define points located approximately along a common horizontal line.

4. The cap of claim 3 wherein the lower end of the tube is sealed to the off set opening.

5. The cap of claim 4 further including a vertical stop pin secured to the inner surface of the lip and disposed between the ends of the lip to limit the degree of rotation of the nozzle in the closed position.

6. The cap of claim 5 wherein the nozzle when in the open position engages the posts.

* * * * *